United States Patent [19]

Solimine

[11] 4,054,297

[45] Oct. 18, 1977

[54] WEIGHT BIASED STEERING MECHANISM

[75] Inventor: John S. Solimine, San Francisco, Calif.

[73] Assignee: Ermico Enterprises, San Francisco, Calif.

[21] Appl. No.: 697,463

[22] Filed: June 18, 1976

[51] Int. Cl.[2] ..... B62B 3/00

[52] U.S. Cl. ..... 280/87.04 A; 280/11.28

[58] Field of Search ..... 280/87.04 A, 87.04 R, 280/87.01, 87.02, 87.03, 87.05, 11.19, 11.27, 11.28, 111, 112 R, 112 A, 661, 675

[56] References Cited

U.S. PATENT DOCUMENTS

| | | | |
|---|---|---|---|
| 2,201,440 | 5/1940 | Letourneau et al. | 280/87.04 R |
| 2,791,440 | 5/1957 | Guidobaldi | 280/112 A |

FOREIGN PATENT DOCUMENTS

| | | | |
|---|---|---|---|
| 566,835 | 9/1957 | Italy | 280/81 A |

*Primary Examiner*—Joseph F. Peters, Jr.
*Assistant Examiner*—John A. Pekar
*Attorney, Agent, or Firm*—Flehr, Hohbach, Test

[57] ABSTRACT

A steering wheel mechanism in which independent front and rear steering is obtained by weight shifting. A pair of rocker members are pivotally mounted below the front and rear ends of a platform. A pair of spindles are pivotally mounted on king pins at opposite sides of each rocker member, and wheels are mounted on each of the spindles. Pitman arms are interconnected between mid-portions of each frame and steering arms which project from the spindles. Provision is made for changing steering response and for adjusting toe-in.

12 Claims, 3 Drawing Figures

WEIGHT BIASED STEERING MECHANISM

BACKGROUND OF THE INVENTION

This invention relates in general to steering devices such as skateboards and roller skates in which steering is accomplished by shifting of the user's weight on the device.

Conventionally skateboards are constructed with front and rear wheels mounted on a straight axle which in turn is mounted below the board to pivot about an inclined axis to provides caster. These skateboards do not, however, make it possible to provide a camber angle for the wheels because of the straight axle. Existing skateboard also are not capable of providing independent front and rear steering so that the wheels track in a turn, do not provide for toe-in adjustment, do not provide for adjustable steering ratio, and have an axle roll center which is relatively high over the ground.

Roller skate designs have also been provided in which the wheel axles pivot about an inclined axis as the user's weight is shifted. Such designs possess limitations and undesirable features which are similar to those described for conventional skateboards.

OBJECTS AND SUMMARY OF THE INVENTION

It is a general object of the invention to provide a new and improved steering mechanism for skateboards, roller skates or other platforms and devices which can be steered by shifting of the user's weight.

Another object is to provide a mechanism of the type described in which the front and rear wheels are independently steerable, and which provides steering axis inclination, camber and caster.

Another object is to provide a steering structure of the type described which provides for adjustment of toe-in and in which the steering response can be varied.

Another object is to provide a steering structure of the type described which provides a relatively lower roll center for the wheel spindle carrier for improved stability and better maneuverability.

Another object is to provide steerable wheel structure in which interchangeable parts are used for both front and rear wheel trucks.

Another object is to provide a skateboard which in comparison to existing devices is more maneuverable, has better stability and more responsive steering, and which provides better control of the board for safety.

The invention in summary includes a platform which is supported by front and rear wheel trucks. Each truck includes a spindle carrier or rocker member which pivots on a rocker mount below the platform. Each rocker member carries a pair of wheel spindles on king pins which are oriented to provide caster as well as steering axis inclination. The wheels are rotatably mounted on spindle shafts which are inclined to provide negative camber. A pair of pitman arms are pivotally mounted at their inner ends to the frame and at their outer ends to steering arms which project from the spindles. Shifting of the user's weight on the platform pivots the rocker member relative to the carrier so that the pitman arms apply steering moments to the spindles. The lengths of the pitman arms can be changed to adjust toe-in, and the points of connection of the inner ends of the pitman arms can be changed to vary the steering ratio. The steering linkage operates to steer the front and rear wheels in opposite directions so that the wheels track during a turn.

The foregoing and additional objects and features of the invention will appear from the following description in which the preferred embodiments have been set forth in detail in conjunction with the accompanying drawings.

DESCRIPTION OF THE PREFERRED EMBODIMENTS

Figure 1:
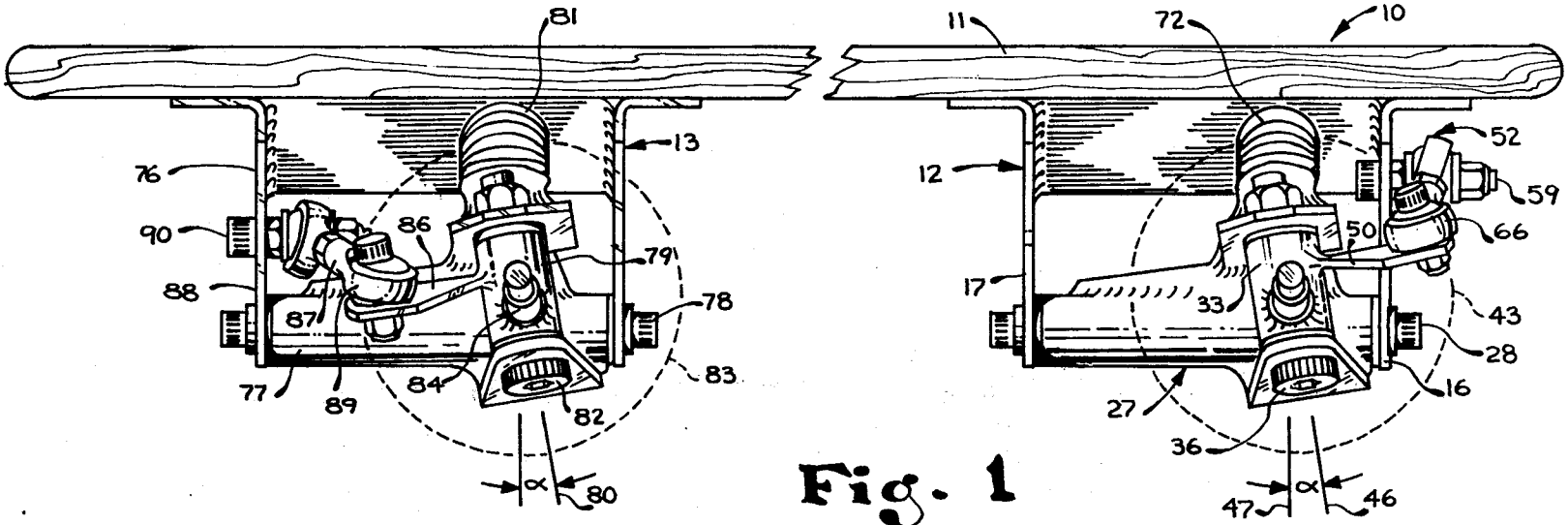
FIG. 1 is a side elevational view, partially broken away, illustrating a skateboard incorporating the invention and showing the wheels in phantom.

In the drawings one preferred embodiment of the invention comprising a skateboard is designed generally at 10. While the invention will be specifically described in connection with a skateboard it is understood that the invention will also find application as a steering mechanism for other platforms of structure, e.g. roller skates.

Skateboard 10 comprises an elongate flat board or platform 11 upon which the individual stands. Front and rear wheel structures or trucks 12, 13 are provided below opposite ends of the board.

Figure 2:
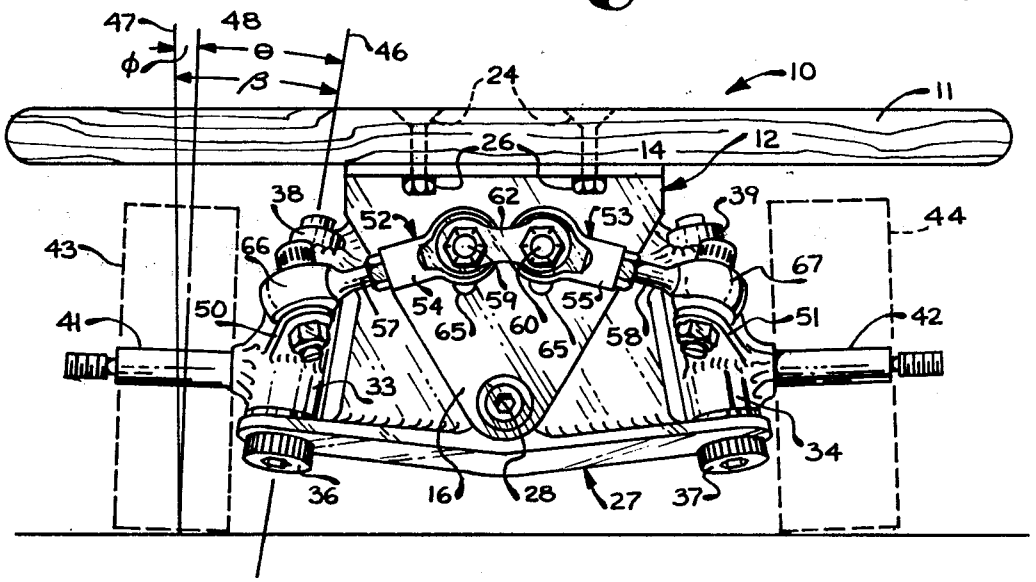
FIG. 2 is a front elevational view of the skateboard of FIG. 1.
Figure 3:
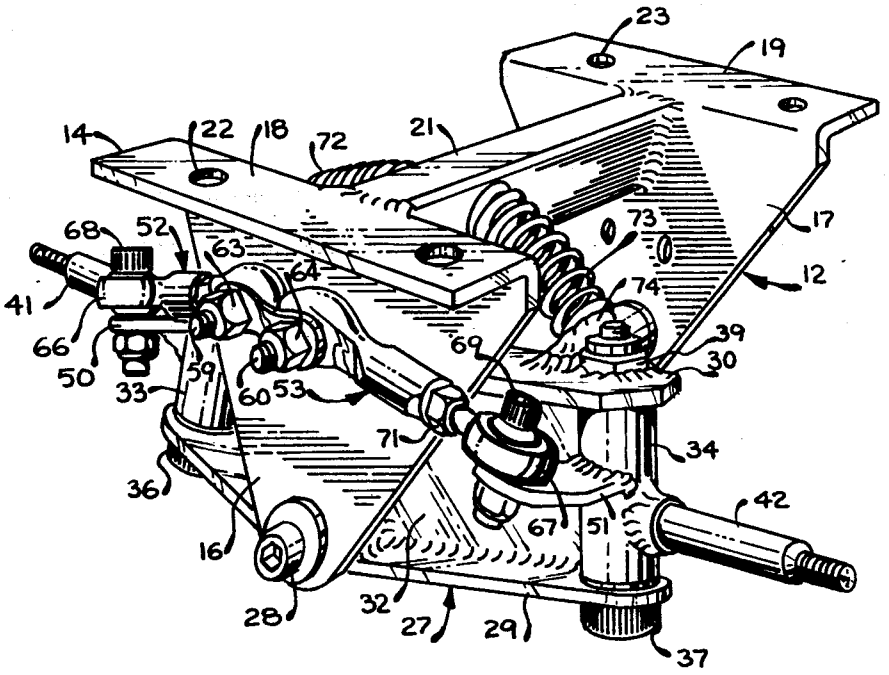
FIG. 3 is a perspective view of component elements of one wheel truck for the skateboard of FIG. 1.

Front wheel truck 12 is illustrated in detail in FIG. 3 and includes a frame weldment or rocker mount 14 comprised of a pair of parallel-spaced triangular-shaped vertical plates 16, 17 formed with top flanges 18, 19 and a T-shaped spine 21 welded at its opposite ends to the two plates. Pairs of holes 22, 23 are formed in the two flanges for receiving mounting bolts 24 (FIG. 2) which extend downwardly through vertical holes formed in the board. Nuts 26 are threaded onto the ends of the bolts to lock the frame beneath the board.

A spindle carrier or rocker member 27 is mounted between the frame plates by means of a bolt 28 for pivotal movement about a longitudinal axis. The bolt extends through a pair of aligned openings formed at the lower portion of the frame to thereby provide a relatively low roll center of the spindle carrier for improved stability. Rocker member 27 comprises a pair of flat flanges 29, 30 secured to the top and bottom sides of a vertical web 32 by means such as welding.

A pair of laterally spaced-apart wheel spindles 33, 34 are mounted on opposite sides of the rocker member by means of king pins 36, 37. The king pins extend through aligned holes formed in the rocker flanges as well as through central bores formed in the spindles. Nuts 38, 39 are threaded onto the upper ends of the king pins to lock the spindles in place. Wheel axles 41, 42 extend radially from the spindles, and wheels 43, 44, preferably of a rigid durable plastic material, are rotatably mounted on these axles. The distal ends of the axles are threaded for receiving suitable lock nuts, not shown, to capture the wheels onto the axles.

As best shown in FIG. 1 for the front wheel truck, the steering axis about which the spindle 33 rotates on king pin 36 is set at a backward tilt from vertical axis 47 at an angle $\alpha$ in the range of 10° to 15°, and preferably 10°. This backward tilt creates positive caster to provide directional stability for the skateboard.

As best shown in FIG. 2 king pin axis 46 is also set at a lateral inward tilt at an angle $\beta$ from vertical axis 47 to provide steering axis inclination for steering stability. Preferably the steering axis inclination is at an angle $\beta$ on the order of 10°. FIG. 2 also illustrates the provision of camber in the wheel structure. Wheel axle 41 is set at an angle from the king pin so that the plane of rotation 48 of wheel 43 defines an included angle $\phi$ with steering axis 46. Preferably the angle $\theta$ is 8°. With a steering axis angle $\beta$ of 10°, a negative camber angle $\phi$ of 2° is thereby created between the plane of wheel rotation and the vertical. The provision of this camber angle achieves lower rolling resistance and friction so that speed is increased.

Steering linkage means is provided for conjointly turning the two front spindles, 33, 34 about the king pins. The steering linkage means includes a pair of steering arms 50, 51 which are mounted on and project from the spindles along forwardly directed axes. The steering arms can, as desired, project along forwardly inclined axes to provide ackermann, i.e. automatic toe-out during a turn. The steering means further includes a pair of adjustable length pitman arms 52, 53. Each pitman arm comprises an inner end 54, 55 which threadably carries outer ends 57, 58. The pitman arms are pivotally connected at their inner ends to a pair of laterally spaced holes formed in a mid-portion of frame plate 16 by suitable bolts 59, 60. A rigid link 62 interconnects the outer ends of the two bolts and a pair of nuts 63, 64 lock the links in place. One or more pair of alternate holes 65 are formed in plate 16 vertically below the first hole pair for repositioning the points of connection of the inner ends of the pitman arms. This changes the length of the moment arm acting on the steering arms to thereby vary the steering response. The outer ends 57, 58 are pivotally mounted on the steering arms by joints 66, 67 which are of a suitable construction providing a limited range of relative twisting motion during steering so that the connection does not bind. Such a connection can be that sold under the trademark Heim Joint comprising a ball and socket with the balls secured by bolts 68, 69 to the ends of the steering arms and with the sockets secured to the pitman arms. The inner and outer ends of the pitman arms can be threadedly turned for length adjustment and lock nuts 71 are mounted on the outer ends to lock the parts together. The length of each pitman arm can thereby be selectively varied to set up and adjust the degree of toe-in of the wheels on each truck.

A pair of centering springs 72, 73 are provided to yieldably urge rocker member 27 to a centered position about the longitudinal axis of the frame. Each spring is mounted at its upper end about a boss formed on either side of spine 21, and each spring is also mounted at its lower end to a boss 74 formed on the upper flange of the carrier.

Rear wheel truck 13 is similar in construction to the front wheel truck with provision being made for turning of the rear wheels in a direction opposite to that of the front wheels so that the wheels track in a turn. A frame weldment 76 is mounted by suitable fasteners below the rear end of the board. The frame mounts a rocker member 77 for pivotal movement about a longitudinal axis by means of a bolt 78. The rocker member in turn mounts a pair of spindles 79 for rotation about an inclined steering axis 80 by means of king pins 82. Springs 81 center the rocker member on the frame. Wheels 83 are rotatably mounted on axles 84 of the spindles and suitable fasteners are threaded on the ends of the axles to capture the wheels.

Steering arms 86 project from spindles 79 in a rearward direction. A pair of adjustable length pitman arms 87 are interconnected between bolts 88 mounted in a pair of holes formed through rear plate 90 and a pair of Heim joints 89 are mounted on the outer ends of the steering arm. One or more additional pairs of holes are formed at vertically spaced positions on the rear plate to provide alternate mounting positions for adjusting the steering response.

The frame 13, rocker member 77, spindles 79, wheels 83, king pins 82, pitman arms 87 and associated springs and fasteners of the rear wheel truck can be of identical construction to those employed on the front wheel truck to achieve parts interchangeability. Rocker member 77 is oriented in the same relative position as the front rocker so that the positive caster angle $\alpha$ is provided, as illustrated in FIG. 1. The steering axis angle and camber angle of the rear wheel truck is the same as that for the front truck. Then a spindle from a front truck is to be used on the wheel truck when it is necessary to reverse the side on which the spindle is mounted so that the steering arms project in the proper direction. For example, the right spindle 33 on the front truck would be turned 180° about a vertical axis and mounted on the left side of the rear truck.

In operation with the skateboard being propelled forward a turn is initiated by the user shifting his weight over the board in the direction of the turn. For example, assume that a turn to the right of FIG. 2 is desired. A weight shift in this direction is carried through to cause frame 12 to pivot about bolt 28 relative to the rocker member in a clockwise direction as viewed in FIG. 2. On the front wheel truck this pivotal movement carries the two pitman arms 54, 55 to the right thereby applying steering moments to both steering arms of the spindles. The wheels are then turned about the steering axes 46 in a counterclockwise direction as viewed from above. This same weight shift causes rear frame 12 to pivot relative to the rear socket in a clockwise direction as viewed front on, and this also carries the two rear pitman arms 87 to the right. Because steering arms 86 project rearwardly the steering moment applied by the pitman arms turns the rear spindles in a clockwise direction as viewed from above. The rear wheels thereby track, or follow the same curved path, with the front wheels.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A weight biased steering mechanism for supporting a platform, comprising the combination of a rocker member carried on the platform for pivotal movement about a first axis extending lengthwise of said platform, a pair of spindles mounted on the rocker member for rotation about upright steering axes which are spaced apart in a direction lateral of said platform, and steering linkage means interconnecting each spindle with a lateral mid-portion of the platform for applying a force moment to a respective spindle about its steering axis responsive to pivotal movement of the platform relative to the rocker member as weight is shifted on the platform.

2. A steering mechanism as in claim 1 in which a steering arm projects radially from each of the spindles, and the steering linkage means includes a pair of pitman arms, each pitman arm having an inner end and an outer end, means connecting the outer ends of each pitman arm with a respective steering arm, and means connecting the inner end of each pitman arm with said lateral mid-portion of the platform.

3. A steering mechanism as in claim 2 which includes a rocker mount secured to the platform with the rocker member carried on the rocker mount, means on the rocker mount for accepting the connection of the inner ends of the pitman arms at a plurality of vertically spaced locations whereby the steering response of the wheels can be selectively varied by changing the point of connection of the inner ends of the pitman arms.

4. A steering mechanism as in claim 2 which includes wheel means mounted on the spindles for rotation about laterally extending axes.

5. A steering mechanism as in claim 4 in which the wheel axes of the spindles are set at a predetermined acute angle with respect to the steering axis whereby the plane of rotation of the wheels is inclined from a vertical plane at a predetermined camber angle.

6. A steering mechanism as in claim 2 in which each pitman arm is connected at its outer end with a respective spindle at a radius from the steering axis, and means for selectively changing the length of each pitman arm to vary the degree of toe-in of the wheels about the steering axis.

7. A steering mechanism as in claim 4 in which the steering axes of the spindles are inclined to diverge downwardly and forwardly from a vertical direction to provide positive caster.

8. A steering mechanism as in claim 1 which includes a second rocker member carried on the platform in lengthwise spaced relationship from the first-mentioned member with the second member being pivotal about said first axis, a pair of second spindles mounted on the second rocker member for rotation about second upright steering axis which are spaced-apart in a direction lateral of said platform, a pair of forwardly projecting front steering arms mounted on each of the first-mentioned spindles, a pair of rearwardly projecting rear steering arms mounted on each of the second spindles, said steering means including a first pair of links each having inner and outer ends with their inner ends connected to a lateral mid-portion of the platform and their outer ends connected to respective front steering arms, and a second pair of links each having inner and outer ends with their inner ends connected to a lateral mid-portion of the platform and their outer ends connected to respective rear steering arms whereby pivotal movement of the platform relative to the rocker members applies steering force moments through the links which turn the front and rear spindles in opposite directions so that the wheel track along a curved path.

9. A steering mechanism as in claim 1 in which a pair of laterally spaced-apart king pins are mounted on the rocker member, and the spindles are mounted on the king pins for rotation about the steering axes.

10. A steering mechanism as in claim 1 in which the platform comprises a skateboard together with frame means below the skateboard, a pair of said rocker members are pivotally mounted on opposite ends of the frame means with each rocker member mounting a pair of laterally-spaced upright king pins, one of said spindles is rotatably mounted on a respective king pin, and said steering means interconnects each wheel spindle with a mid-portion of the frame means.

11. A steering mechanism as in claim 1 which includes means for yieldably urging said rocker member about the first axis to a centered position with respect to the platform.

12. A skateboard including the combination of an elongate platform having front and rear ends, a front frame mounted below the front end of the platform and a rear frame mounted below the rear end of the platform, front and rear rocker members mounted on respective front and rear frames for pivotal movement about axes which extend lengthwise of said platform, front and rear pairs of wheel spindles mounted on respective rocker members at positions spaced laterally of the platform for rotation about upright steering axes, a steering arm projecting radially from each spindle, a wheel mounted for rotation on each spindle, a pair of front steering links each of which has an inner end and an outer end, each front link being pivotally connected at its inner end with a lateral mid-portion of the front frame at a position located forward of the front wheel spindles and pivotally connected at its outer end with a respective steering arm on the front spindles, and a pair of rear steering links each of which has an inner end and an outer end, each rear link being pivotally connected at its inner end with a lateral mid-portion of the rear frame at a position located rearward of the rear wheel spindles and pivotally connected at its outer end with a respective steering wheel on the rear spindles, with said links simultaneously applying steering moments in respective opposite directions to the front and rear wheels responsive to relative pivotal movement between the frames and platform as the weight of the user is shifted over the platform.

* * * * *